United States Patent [19]

De Long

[11] 4,423,513

[45] Dec. 27, 1983

[54] FURNACE PANEL FOR USE IN AN ARC FURNACE

[75] Inventor: James E. De Long, Waterloo, Iowa

[73] Assignee: Deere & Company, Moline, Ill.

[21] Appl. No.: 393,007

[22] Filed: Jun. 28, 1982

[51] Int. Cl.[3] ..... F27D 1/12

[52] U.S. Cl. ..... 373/76; 432/238

[58] Field of Search ..... 373/76, 73, 74, 75, 373/165; 432/237, 238; 110/336

[56] References Cited

U.S. PATENT DOCUMENTS 3,843,106 10/1974 Nanyjo et al. ..... 373/76

4,119,792 10/1978 Elsner et al. ..... 373/76

*Primary Examiner*—Roy N. Envall, Jr.

[57] ABSTRACT

A furnace panel for use in an arc furnace is disclosed having a cast iron block with first and second surfaces and with a cooling circuit located therebetween. The block has at least one anchoring member projecting outwards from its second surface for retaining the block to a wall of the furnace. The panel further includes steel studs embedded in the cast iron block which project outwards from the first surface and which have a profile which enhances containment of molten slag against the first surface to prolong the life of the block. As the molten slag is splashed onto the first surface of the block, the steel studs protrude outward similar to fingers on a hand, and catch the slag and retain it until it momentarily solidifies. Once the slag has solidified, it acts as an insulating layer to prevent erosion of the block by the further impingement of additional molten slag.

2 Claims, 6 Drawing Figures

FIG. 1
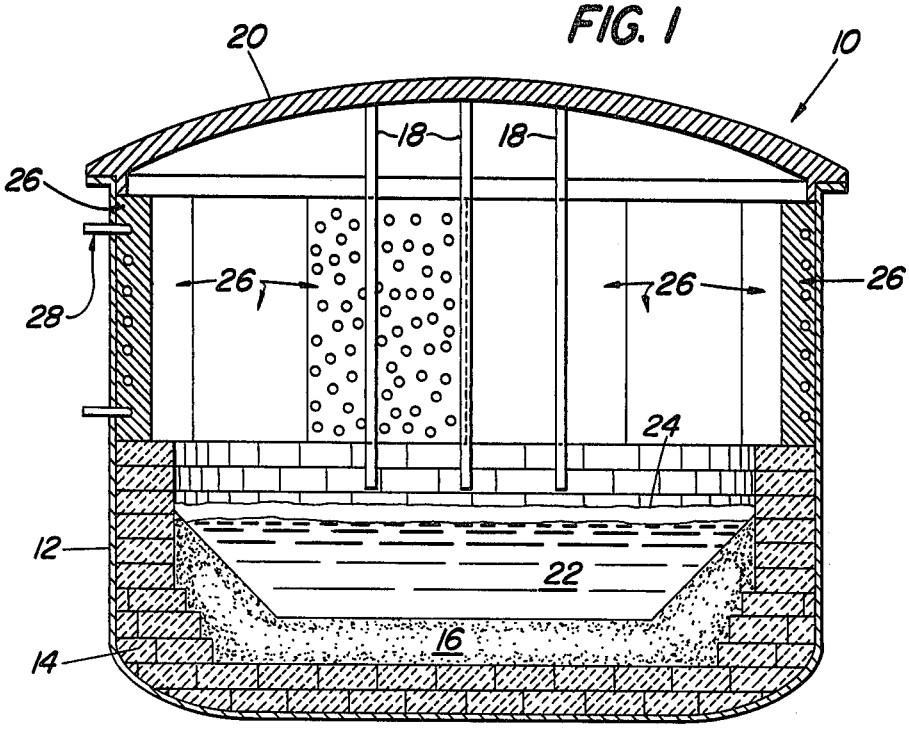
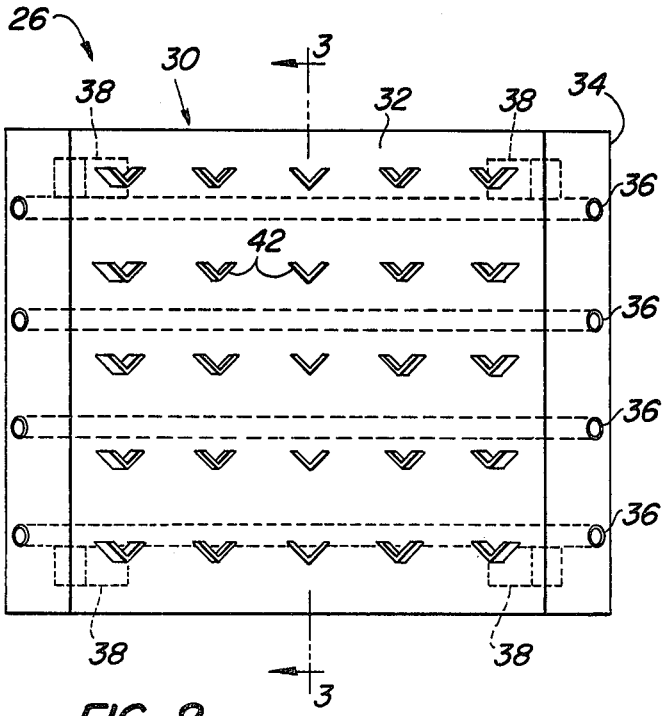
FIG. 2
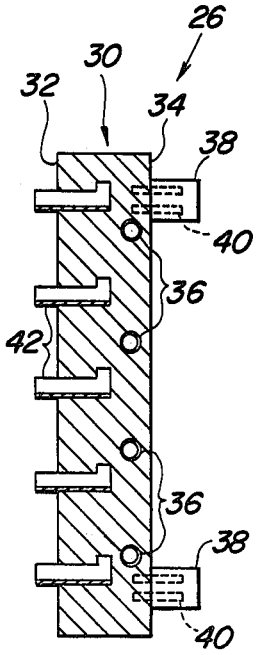
FIG. 3

FURNACE PANEL FOR USE IN AN ARC FURNACE

FIELD OF THE INVENTION

This invention relates to a furnace panel for use in an arc furnace and more particularly to a studded furnace panel which retains molten slag and exhibits a longer life than conventional panels.

BACKGROUND OF THE INVENTION

Electric arc furnaces are constructed with refractory brick up to about a foot above the molten metal level. Above this level, water-cooled panels are normally employed since they are more cost efficient. As the scrap metal is heated above its melting temperature, it becomes molten and the impurities in it rise to the surface and form what is known as slag. Both the slag and molten metal are splattered onto the panels by the electric arc and, over time, will cause the panels to erode. Once the panels become severely eroded, they have to be replaced and this necessitates shutting down the furnace. By prolonging the life of the panels, both the cost and effort required to replace the panels can be reduced.

Now a furnace panel has been invented with exhibits a longer life.

SUMMARY OF THE INVENTION

Briefly, this invention relates to a furnace panel for use in an arc furnace. The panel includes a cast iron block which has a first surface which faces the interior of the furnace, a second surface which faces the exterior wall of the furnace, and a cooling circuit located therebetween. Steel studs are embedded in the block and project outward from the first surface. The studs have a given profile and are so arranged as to be able to retain molten slag against the first surface of the block. The trapped slag acts as a layer of insulation to prolong the life of the panel and reduce heat loss from the furnace to the cooling circuit. Each block also contains an anchor member projecting outward from the second surface for holding the block securely to an exterior wall of the furnace.

The general object of this invention is to provide a furnace panel for use in an arc furnace which has an extended life over conventional panels. A more specific object of this invention is to provide a furnace panel for use in an arc furnace which retains applied refractory, slag and splattered metal by using a plurality of steel studs.

Another object of this invention is to provide a sacrificial furnace panel that is capable of retaining applied refractory, slag and splattered metal even after significant erosion.

Still another object of this invention is to provide a furnace panel for use in an arc furnace which provides a visual indication to the furnace operator of when the panel has to be replaced.

Other objects and advantages of the present invention will become more apparent to those skilled in the art in view of the following description and the accompanying drawings.

BRIEF DESCRIPTION OF THE DRAWINGS

FIG. 1 is a side elevational view of an arc furnace using the furnace panels of this invention.

FIG. 2 is a front view of a furnace panel having a uniform stud pattern.

FIG. 3 is a side view of FIG. 2.

DETAILED DESCRIPTION OF THE PREFERRED EMBODIMENTS

Figure 4:
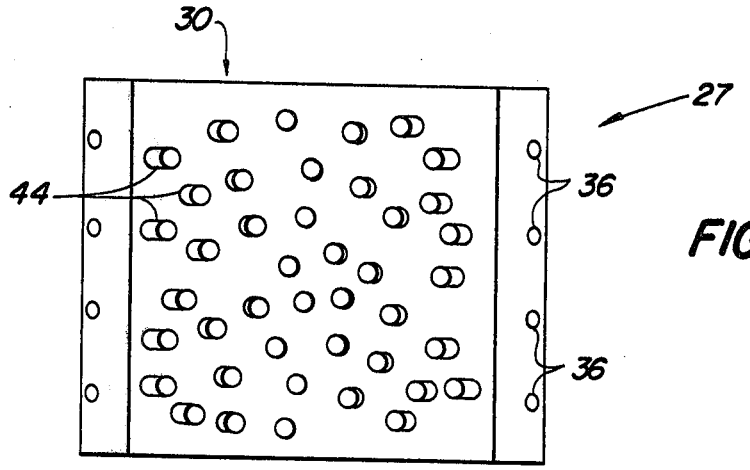
FIG. 4 is a front view of a furnace panel showing studs having a different profile and arranged in a non-uniform pattern.

Referring to FIG. 1, an arc furnace 10 is shown having an outer steel wall 12 lined on the inside with refractory brick 14 and sand 16. Scrap iron is dumped into the furnace 10 and is heated to a temperature above its melting point by means of electrodes 18 which extend through a dome roof 20 of the furnace 10. The electrodes 18 supply electric energy which arcs through the air onto the metal and therein transforms primarily into heat, which causes the scrap metal to melt into a molten bath 22. The molten slag 24, normally lies on the molten bath 22, consists of silicon dioxides, silicon oxides and various impurities that were present in the metal.

The refractory brick 14, which extends about a foot above the molten bath 22, is thereafter replaced by furnace panels 26 constructed of either cast iron or steel. The furnace panels 26 normally have a longer life when exposed to the impingement of molten slag than do the refractory bricks 14. Normally, the furnace panels 26 are formed with an integral cooling circuit 28 which routes a coolant, such as water, through the panels 26 to carry away heat. The furnace panels 26 are sacrificial in nature and must be replaced periodically. Therefore, by prolonging the life of the panels 26, the cost of new panels and the labor cost incurred in the replacement of such panels can be reduced.

Referring now to FIGS. 2 and 3, a furnace panel 26 is shown having a cast iron block 30 which is preferably arcuate in shape. The block 30 contains an interior or first surface 32 which faces inward towards the center of the furnace 10 and an exterior or second surface 34 which is positioned adjacent to the steel wall 12 or is itself part of the outer wall of the furnace 10. Located between the first and second surfaces, 32 and 34 respectively, are cooling tubes 36 which carry a circulating coolant used to transfer heat away from the furnace panel 26. Projecting outward from the second surface 34 are one or more anchoring members 38 which enable the furnace panel 26 to be securely fastened to the steel wall 12 of the furnace 10. The anchoring members 38 can be bolts, threaded studs, hooks, pins, etc. Preferably, the anchoring members 38 are cast iron tabs which are reinforced with steel pins 40 and are formed integral with the cast iron block 30.

Projecting outward from the first surface 32 of the furnace panel 26 is a plurality of steel studs 42 which are shown having a V-shaped profile. The studs 42 are arranged in a uniform pattern in the block 30 and, as seen in FIG. 3, project outward from the first surface 32 approximately 25 percent of their overall length. For a typical cast iron block 30, which is about seven inches thick, the studs 42 are about four inches long and project outward about one inch. The studs 42, being made of steel, have a higher melting point than that of the cast iron block 30. The function of the studs 42 is to retain refractory sprayed onto the panels 26 and metal and slag splashed up from the molten bath 22. If the studs 42 were iron, they would erode quickly and the slag retaining benefits would be lost. The steel studs 42 erode more slowly than the cast iron block 30. Consequently, even after severe erosion of the cast iron block 30, the steel studs 42 continue to protrude. In a typical arc furnace, there are what is known as hot spots which are located above the molten bath 22 and at points located by drawing a line between the center of the furnace 10 and the extreme lower ends of the electrode 18. For a furnace having three electrodes, there would be three primary hot spots located radially outward on the three lines above described. The hot spots are a result of the magnetic effect of the electrodes acting upon each other, such that each produces a repulsion towards the arc produced by the other electrodes. These repulsion forces force the arc of each electrode radially outwards and downwards at an angle of about forty-five degrees. As each electrical arc strikes the top surface of the molten bath 22, it produces an angle incident thereto which splashes slag and metal up against the furnace panels 26. As the hot metal impinges on the first surface 32 of a given furnace panel 26, it tends to erode the cast iron block 30. Over a period of time, this erosion will wear the first surface 32 of the block 30 to the point where the cooling conduits 36 are exposed, at which time the panel 26 will have to be replaced. The function of the studs 42 is to retain sprayed refractory or slag and metal which splashes up on the furnace panel 26 such that the slag itself adheres to the block 30 and forms a layer of insulation thereon. As the splattered metal or slag momentarily solidifies on the first surface 32 of the block 30, it is held in place by the protruding studs 42. Subsequent splashes of hot metal or slag may erode away part of the solidfied slag or provide more metal or slag which may also solidify. One can visualize that this process of eroding and replacing the refractory, metal and slag onto the first surface 32 of the block 30 hinders the erosion of the cast iron block 30 itself. Therefore, the useful life of each furnace panel 26 is appreciably extended.

Referring to FIG. 4, a furnace panel 27 is shown having a plurality of outward protruding studs 44 arranged in a nonuniform pattern and having a circular cross-sectional profile. The particular pattern in which the studs are arranged along with their profile and spacing can enhance their ability to retain the slag. For example, experiment has shown that arranging the studs approximately two inches apart produces satisfactory results. It is also important to note that the cross-sectional configuration of the studs can vary from the V-shape, the cylindrical shape and the semi-circular cup shape shown in FIGS. 2, 4 and 5 respectively. It is felt that a generally U-shaped or V-shaped configuration, wherein the stud itself is able to retain a portion of the slag in an outward projecting pocket, produces the best results.

Figure 5:
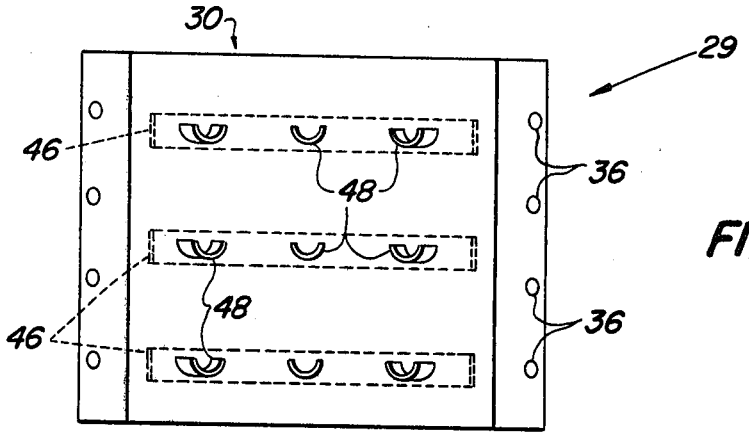
FIG. 5 is a front view of another embodiment of the furnace panel showing multiple studs secured to a steel bar which is totally embedded in a cast iron block.

Referring to FIG. 5, another embodiment of a furnace panel 29 is shown wherein steel bars 46 are totally embedded within the cast iron block 30. Physically connected, such as by welding, to one side of the steel bars 46 are a plurality of outwardly projecting studs 48 which extend beyond the first surface 32 of the block 30 approximately 25 percent of their overall length. The bars 46 provide an easy means of aligning the studs 48 within the furnace panel 29 when the cast iron block 30 is formed. In addition, the bars 46 allow a greater amount of erosion of the block 30 before the studs 48 actually separate from the block 30. By having individual studs embedded into the block 30, it is possible that erosion of one section of the block will cause the studs located in that section to individually fall out. While the embodiment shown in FIG. 5 would prohibit the falling out of any one stud until all the cast iron which holds that particular bar 46 in place is eroded away.

Figure 6:
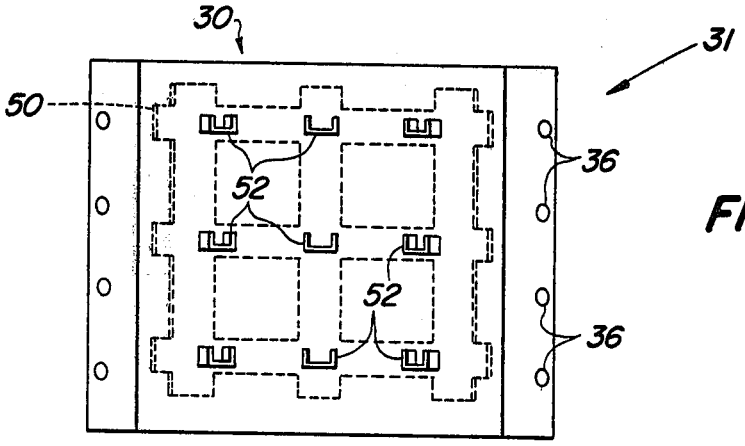
FIG. 6 is a front view of still another embodiment of the furnace panel showing the studs secured to a steel grid which is totally embedded in a cast iron block.

Turning now to FIG. 6, another embodiment of a furnace panel 31 is shown wherein a steel grid 50 is totally embedded within the cast iron block 30. Like the bars 46 in FIG. 5, the steel grid 50 physically retains a plurality of outward extending studs 52 which are attached to it, such as by welding. The studs 52 project outwards from the first surface 32 of the block 30 in the usual manner. The purpose of the steel grid is similar to that of the bars 46 discussed above, in that it allows many studs to be physically aligned within the block 30 as it is being formed and also prevents individual studs from falling out of the block 30 due to erosion of a portion of the cast iron.

It should be noted that the furnace panels 26, 27, 29 and 31 have been described as having cooling conduits 36 integrally formed therein and having anchoring members 38 extending outward from the second surface 32. However, as will be apparent to those skilled in the art, the cooling coils may be placed behind the furnace panels and/or other types of attachment mechanisms, such as vertical support members, could be used in place of the anchoring members 38. Such features are seen as being covered by this invention.

While the invention has been described in conjunction with several specific embodiments, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. A furnace panel for use in an arc furnace comprising:

(a) a cast iron block having an inner and an outer surface and which encloses cooling coils between said surfaces, said block having at least one anchoring member projecting outward from said outer surface for retaining said block to a wall of said furnace; and (b) steel bars fully embedded in said block and having a plurality of steel studs projecting outward therefrom which extend at least twenty-five percent of their length beyond said inner surface of said block, said studs having a profile which enhances containment of molten slag against said inner surface of said block during furnace operation to prolong the life of said block.

2. A furnace panel for use in an arc furnace comprising:

(a) a cast iron block having an inner and an outer surface and which encloses cooling coils between said surfaces, said block having anchoring members projecting outward from said outer surface for retaining said block to a wall of said furnace; and (b) a steel grid fully embedded in said block and having a plurality of steel studs projecting outward thereform which extend at least twenty-five percent of their length beyond said inner surface of said block, said studs arranged so as to enhance containment of molten slag against said inner surface of said block during furnace operation to prolong the life of said block.

* * * * *

UNITED STATES PATENT AND TRADEMARK OFFICE

CERTIFICATE OF CORRECTION

PATENT NO. : 4,423,513

DATED : 27 December 1983

INVENTOR(S) : James E. DeLong

It is certified that error appears in the above-identified patent and that said Letters Patent is hereby corrected as shown below:

Column 4, line 62, delete "thereform" and insert -- therefrom --.

Signed and Sealed this

*Eighteenth* Day of *September 1984*

[SEAL]

*Attest:*

GERALD J. MOSSINGHOFF

*Attesting Officer*

*Commissioner of Patents and Trademarks*